United States Patent [19]

Bruski

[11] Patent Number: 4,761,266

[45] Date of Patent: Aug. 2, 1988

[54] CONTROLLED ADDITION OF LITHIUM TO MOLTEN ALUMINUM

[75] Inventor: Richard S. Bruski, Martinez, Calif.

[73] Assignee: Kaiser Aluminum & Chemical Corporation, Oakland, Calif.

[21] Appl. No.: 64,431

[22] Filed: Jun. 22, 1987

[51] Int. Cl.[4] ..... C22C 1/00; C22C 21/00

[52] U.S. Cl. ..... 420/528; 420/590; 266/95

[58] Field of Search ..... 420/528, 590, 129; 222/592

[56] References Cited

U.S. PATENT DOCUMENTS

| | | | |
|---|---|---|---|
| 2,260,226 | 10/1941 | Kirkham | 266/216 |
| 3,128,912 | 4/1964 | Cash | 222/596 |
| 4,078,706 | 3/1978 | Hanuszczak | 222/596 |
| 4,191,563 | 3/1980 | Smartt et al. | 420/20 |
| 4,248,630 | 2/1981 | Balmuth | 420/528 |
| 4,556,535 | 12/1985 | Bowman et al. | 420/528 |

*Primary Examiner*—L. Dewayne Rutledge
*Assistant Examiner*—David Schumaker
*Attorney, Agent, or Firm*—Andrew E. Barlay

[57] ABSTRACT

Lithium feed to an aluminum-lithium alloy production system is achieved at a highly controlled rate by advancing a plunger at a predetermined volumetric rate into a body of molten lithium retained in a holding vessel to displace the lithium toward an overflow port through which it is fed into a mixing vessel where it is combined with molten aluminum. Control of the aluminum feed rate is achieved by maintaining a constant head height upstream of an orifice. The thus metered streams of molten lithium and aluminum are then combined in a vortex bowl, whose outlet is then fed to a casting station.

10 Claims, 4 Drawing Sheets

CONTROLLED ADDITION OF LITHIUM TO MOLTEN ALUMINUM

BACKGROUND AND SUMMARY OF THE INVENTION

This invention relates to the production of aluminum-lithium alloys. In particular, this invention relates to methods for controlling the relative amounts of lithium and aluminum as they are combined in a continuous alloying process.

The blending of lithium and aluminum presents difficulties not found in other aluminum alloys, due to the explosive character of aluminum-lithium as well as its high tendency to combine with water and form skim plus hydrogen. To address these problems, continuous processes for preparing the alloy have employed electromagnetic metering pumps and flow control systems, which involve a considerable investment of capital.

In addition, extensive flow control systems have been designed to monitor and control the aluminum-lithium ratios. One example is disclosed in Bowman et al., U.S. Pat. No. 4,556,535 (Aluminum Company of America, Dec. 3, 1985).

It has now been discovered that molten lithium can be fed at a highly controlled rate in complete safety by a system which does not require highly sophisticated flow control valves. In one aspect, the invention resides in the use of a plunger in an enclosed lithium holding vessel of stainless steel to displace the lithium through an overflow port by advancing the plunger at a controlled volumetric rate. In a further aspect of the invention, the aluminum feed rate is controlled by maintaining a molten aluminum head at an accurate value above an orifice. The aluminum head and the plunger advance rate are coordinated to achieve a flow ratio which will produce the desired aluminum:lithium ratio in the final alloy.

Further features of the invention including its preferred embodiments are disclosed below.

DETAILED DESCRIPTION OF THE INVENTION AND PREFERRED EMBODIMENTS

Figure 1:
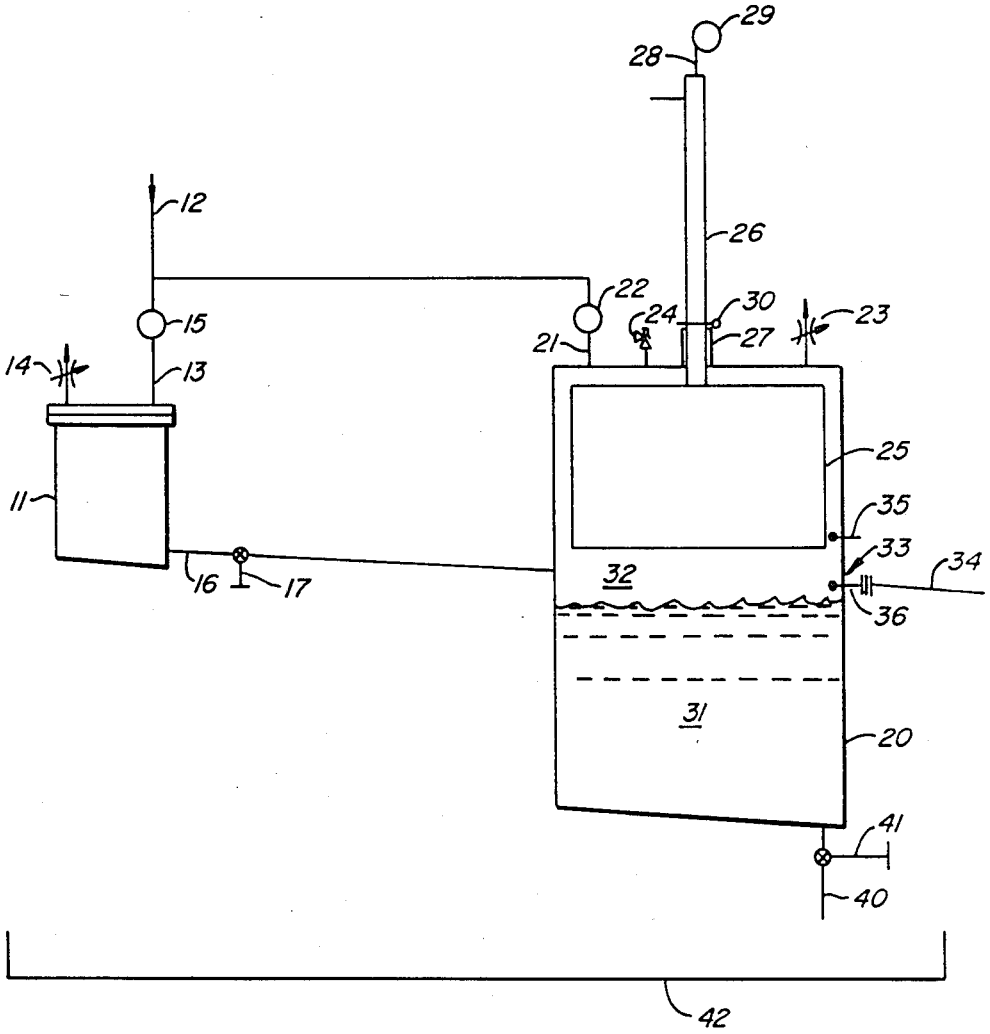
FIG. 1 is a vertical cross section of a melting chamber and displacement vessel for molten lithium feed for use in the process of the invention.

The lithium feed system shown in FIG. 1 feeds molten lithium at a steady rate which is controlled in accordance with the lithium level sought for the product alloy. Solid lithium is first charged to a melt chamber 11, or to one of several such melt chambers arranged in parallel. The chamber is then sealed and purged with an inert gas 12, of which argon is a convenient example.

Argon purging is achieved through an inlet line 13 and vent valve 14, with pressure regulated by a pressure reduction valve 15.

Once inside the chamber and properly purged with inert gas, the lithium is melted by conventional heating elements in the chamber (not shown), and molten lithium is permitted to flow through an outlet line 16 controlled by a shutoff valve 17.

The molten lithium then enters a displacement chamber 20, which is an enclosed chamber purged with inert gas through an inlet line 21 equipped with a pressure reduction valve 22, and released through a vent valve 23, with a high pressure relief valve 24 to guard against excessive pressure buildup. The displacement chamber 20 is fitted with a plunger 25 suspended from a shaft 26 which passes through the roof of the displacement chamber through a seal connection 27. The shaft in turn is suspended by a cable 28 coiled around a servotype drive motor 29 capable of operation at a variable speed. A removable safety pin 30 is included to secure the plunger in a raised position when not in use. Conventional resistance-type heating elements and temperature detectors (such as thermocouples, for example) are positioned at the walls of both the displacement chamber 20 and plunger 25 (not shown), to maintain the lithium in the molten state.

The plunger 25 may assume any of a wide range of shapes. A convenient shape is that of a cylinder, preferably a circular cylinder, such that lowering the plunger at a constant linear rate downward will produce a constant volumetric rate of advancement toward and into the molten lithium.

The molten lithium 31 forms a body of liquid which partially fills the displacement chamber 20 as shown in the figure, leaving an inert gas space 32 above. Prior to the lowering of the plunger 25, the molten lithium is added to a fill line below the level of an overflow port 33. As the plunger is lowered into the body of molten lithium, the lithium level rises to the overflow port 33 and flows out to the discharge line 34. The flow resistance through the discharge line 34 is sufficiently low that the flow rate is determined primarily by the rate by which the molten lithium 31 is displaced by the plunger 25. Liquid level detectors 35, 36, which may be comprised of conventional instrumentation, are included to function as safety devices in the event of line plugging. The upper detector 35 functions as a high level indicator, which shuts down the plunger drive motor 29 when activated (which is an indication of plugging in the discharge line 34).

The construction of the plunger itself is not critical. As one example, the piston may consist of a hollow shell, with steel shot retained in its interior. Its weight can thus be varied by the amount of steel shot.

The molten lithium must at all times be free of solids which have a tendency to form in various parts of the system, notably lithium oxides and hydroxides. For this reason, stainless steel filters are placed in the inlet and outlet lines to the displacement chamber 20, and at other locations in the overall system.

Further features of the embodiment shown in FIG. 1 include a drain line 40, a drain valve 41 and a catch tray 42.

Figure 2:
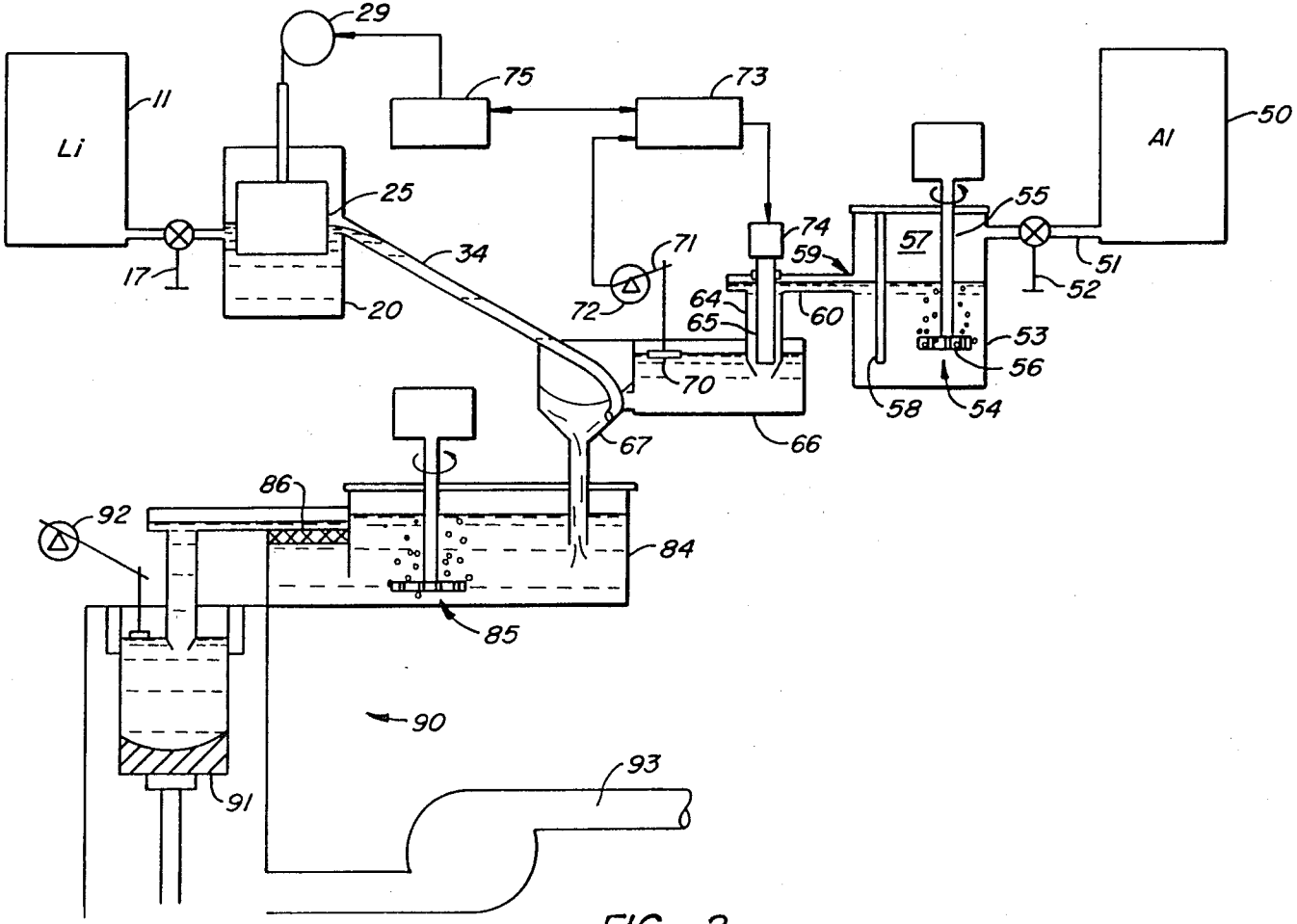
FIG. 2 is a flow chart of a full process for preparing an aluminum-lithium alloy incorporating the lithium feed system of FIG. 1.

FIG. 2 shows the units of FIG. 1 incorporated into the complete alloy production system. The lithium feed units are here combined with an aluminum feed system, which is comprised of a molten aluminum source 50 which discharges molten aluminum through a feed line 51 bearing a shutoff valve 52 to a purging vessel 53 in which the molten aluminum is purged of dissolved gases, such as hydrogen, oxygen and moisture. Purging is achieved through a sparging device 54 which bubbles an inert gas, generally argon or a mixture of argon and chlorine, through the molten aluminum. A typical such unit widely known in the metallurgical industry is one sold by Union Carbide and commonly referred to as a "SNIF" degassing unit. This consists of a rotating hollow shaft 55 terminating in hollow vanes 56 placed below the liquid level. Argon or argon/chlorine passing through the shaft 55 exits through holes in the vanes 56, forming fine bubbles, thereby both mixing and purging the molten metal. The same inert gas occupies the gas space 57 of the molten metal. Once purged, the molten metal passes around a baffle 58, then out an exit port 59 into a transfer trough 60.

From the trough 60 the molten aluminum enters a flow control passageway 64. A moveable pin 65 inside the passageway controls the flow of molten metal therethrough by its position. This variable control is attributable to the contours of the inner surface of the passageway and the outer surface of the pin. These surfaces are shaped in such a manner that the resistance which the molten metal encounters due to its viscosity as it passes through the narrow space between these surfaces varies with the location of the pin. This may be achieved by a tapering portion at the lower opening of the passageway as suggested by the drawing, such that the flow constriction increases as the pin is lowered. The vertical pin arrangement as shown is preferred.

The molten metal leaving the passageway enters the feed trough 66 which feeds a vortex bowl 67, where the molten aluminum is combined with the molten lithium.

Figure 3:
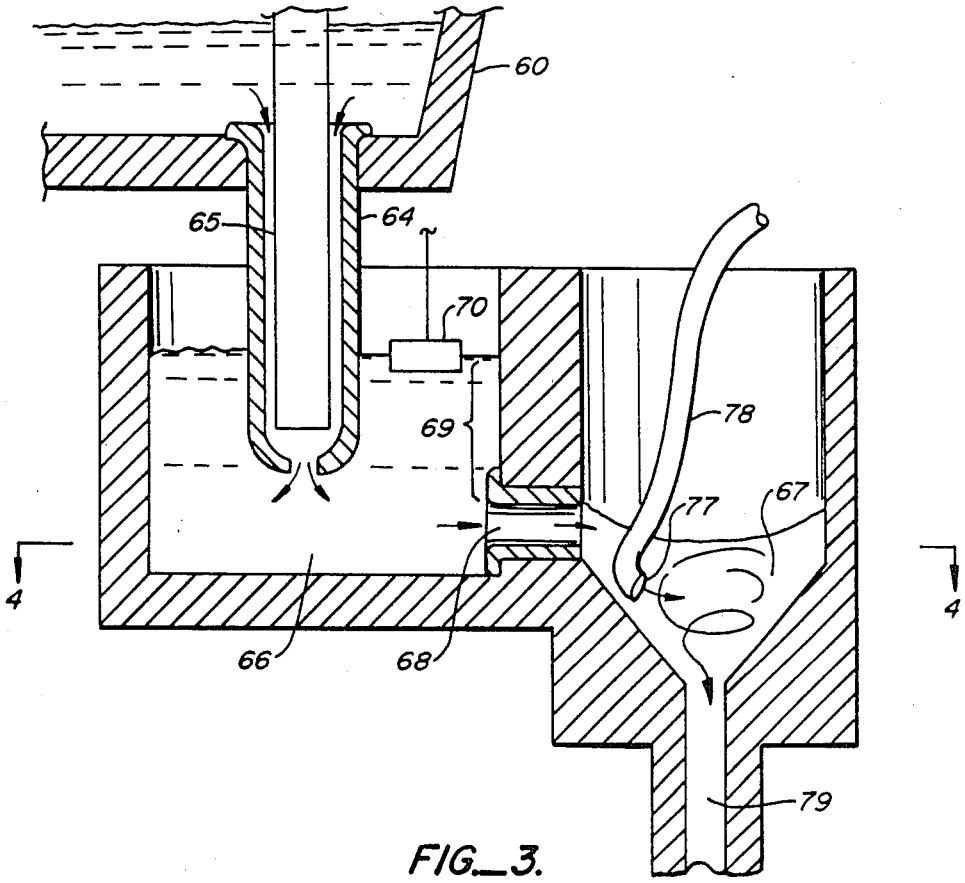
FIG. 3 is a vertical cross section of a portion of the process shown in FIG. 2, representing elements of the aluminum flow metering system and the portion where molten aluminum and lithium are combined.
Figure 4:
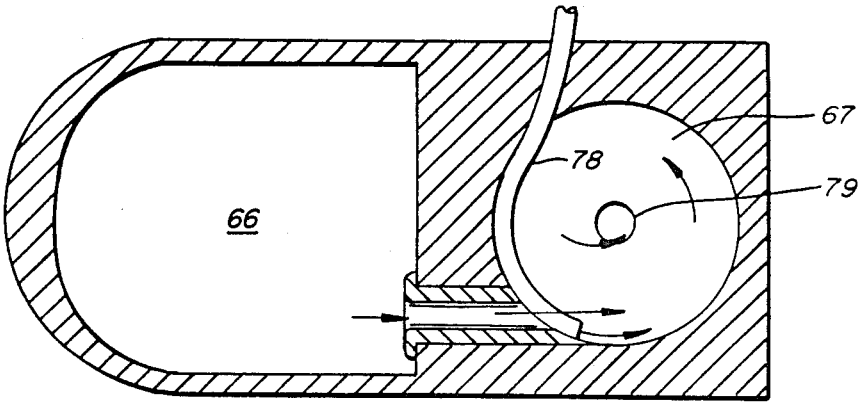
FIG. 4 is a horizontal cross section of the structure shown in FIG. 3, taken along the line 4—4 thereof.

A detailed view of the feed trough 66 and vortex bowl 67 is provided in FIGS. 3 and 4.

In FIG. 3, it can be seen that the molten aluminum flows from the feed trough 66 to the vortex bowl 67 through an orifice 68. The flow rate through the orifice is dependent on the size of the orifice as well as the height of the aluminum head 69 adjacent to the orifice in the feed trough 66. The relationship is determined by conventional fluid mechanics, as influenced by the viscosity of the molten aluminum, and readily determinable by one skilled in the art, either by calculation or routine experimentation. Preferably, the orifice has a horizontal axis as shown.

The selected flow rate through the orifice 68 is maintained by maintaining the head height 69 at a value calculated to produce the desired flow rate. Maintenance of the selected head height is achieved by a control loop between a liquid level detector 70, shown here as a float on the molten metal surface, and the moveable pin 65.

Referring once again to FIG. 2, the position of the float 70 in this embodiment is transmitted to a lever 71 whose tilt angle is detected by an inclinometer 72. A typical inclinometer is a solid-state DC closed-loop force-balance tilt sensor producing an analog DC output signal directly proportional to the sine of the tilt angle. This output signal is fed to a controller 73, which compares the signal to a preset value corresponding to the desired head height, and emits a corresponding signal to a pin position controller 74, which adjusts the pin height accordingly to increase or lessen the rate of flow through the flow control passageway 64. The pin position controller 74 may be a servo-type motor or conventional device, and the controller 73 may be any conventional control circuit capable of comparing an input signal to a set value and producing an output signal in accordance with the comparison.

A further controller 75 controls the operation of the drive motor 29 for the lithium displacement plunger 25. This controller is also conventional equipment, calibrated and manually set to produce the desired lithium flow rate through the discharge line 34. The two controllers 73, 75 may operate independently or may be combined into a single loop for a cascade-type system as shown.

Returning to FIG. 3, the molten aluminum passes through the orifice 68 into the vortex bowl 67, where it combines with molten lithium entering through the mouth 77 of a discharge tube 78. This tube is an extension of the discharge line 34 from the lithium displacement chamber 20 (FIGS. 1 and 2). The mouth 77 of the lithium discharge tube is positioned below the orifice 68 so that the lithium is fed below the surface of the molten aluminum. As shown in FIG. 4, the vortex bowl 67 is in the form of a circular funnel, and the aluminum orifice 68 and the lithium discharge mouth 77 are arranged tangentially to the circular profile of the vortex bowl. The swirling action of the resulting vortex causes full mixing of the aluminum and lithium, which then proceeds as a homogeneous mixture downward through an exit passage 79 at the base of the funnel.

Returning once again to FIGS. 2 and 3, the molten mixture of aluminum and lithium emerging from the exit passage 79 enters a degassing chamber 84, where the mixture is purged in a manner similar to the molten aluminum in the purging vessel 53. A sparging device 85 is used here as well, bubbling argon through the molten aluminum-lithium mixture. The purged mixture is then passed through a filter 86 to remove any oxides and refractory fragments which may have entered the system. The molten mixture then enters an ingot casting station 90. The station shown in FIG. 2 is a vertical, semicontinuous direct chill casting station of conventional construction, in which the ingot is formed on casting table 91 which is lowered at a rate determined by a control system described below. An inclinometer 92 at the liquid level surface monitors the system to control the drop rate, and gases are drawn off through an exhaust 93. Care must be taken in designing the direct chill casting system due to the explosive nature of the aluminum-lithium alloy when exposed to water conditions. Casting or handling of molten aluminum-lithium alloys should never be attempted unless one is knowledgeable of the special safety precautions necessary for these alloys. Such methods and precautions are known to those skilled in the casting of these alloys.

Figure 5:
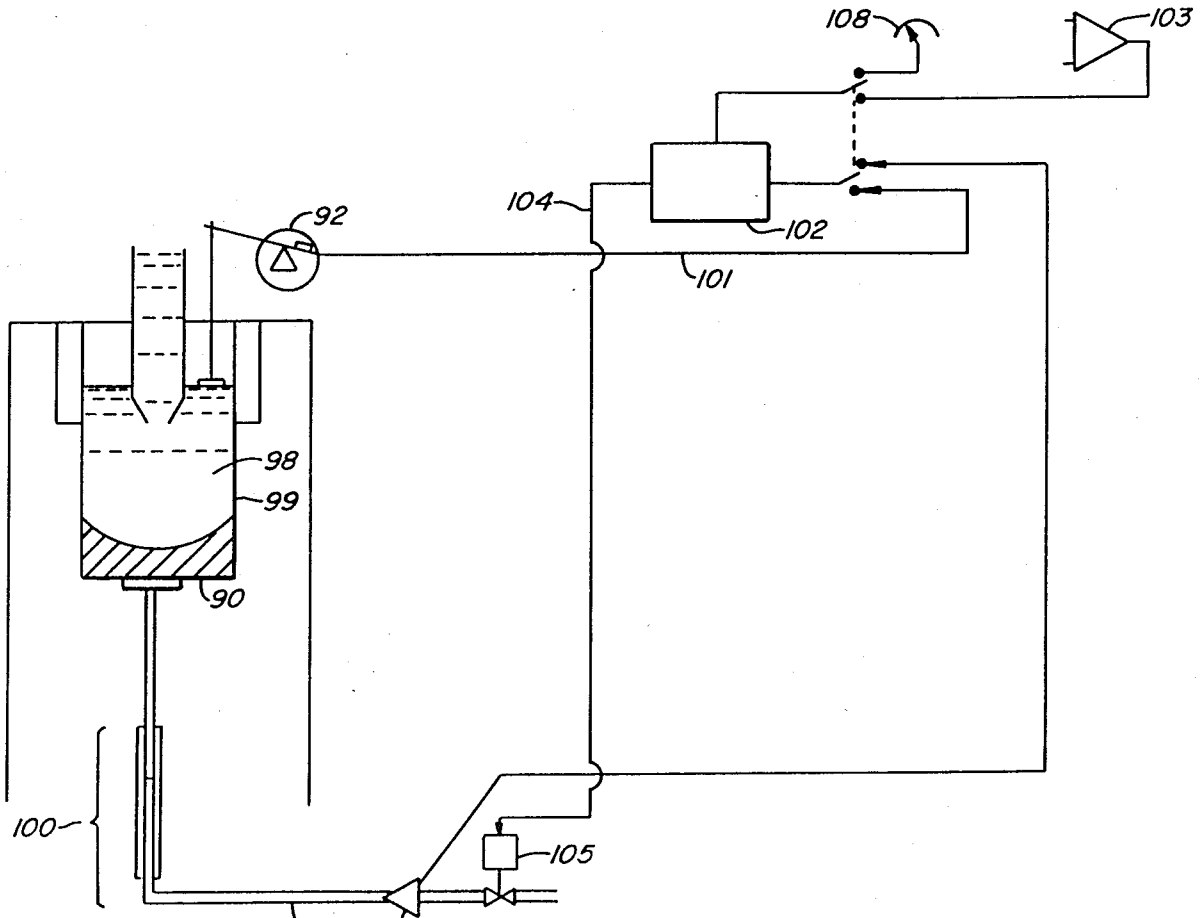
FIG. 5 is a flow chart of a casting station and associated control system for use with the process shown in FIG. 2.

The casting station and its control system are shown in FIG. 5. Molten alloy 98 flows into an open-bottom mold 99 at whose sides a water flow is directed, chilling and solidifying the alloy as it drops. The solidified base of the alloy is supported by the casting table 90, which is lowered by a hydraulic system 100 at a drop rate which corresponds to the rate of solidification in the particular mold used. Aluminum and lithium feeds to the system are selected and controlled as shown in FIGS. 1 and 2 such that their relative feed rates correspond to the desired proportion in the alloy and their combined amounts equal the target drop rate. The actual drop rate is then varied slightly as needed to maintain a constant liquid alloy level in the mold.

This is done by sensing the liquid alloy level with the inclinometer 92, whose output signal 101 is fed to a controller 102 where it is compared with a set point 103. Based on the comparison, the controller 102 emits an output signal 104 to a flow control valve 105 in the hydraulic system, resulting in whatever drop rate variations are necessary to maintain the desired liquid level. Further monitoring of the drop rate is achieved by a flowmeter 106 on the hydraulic fluid line 107, whose signal is read on an indicator 108. Appropriate override functions are incorporated into the system for startup and shutdown conditions.

All components of the system are blanketed in an inert atmosphere, and special materials of construction which are compatible with aluminum-lithium systems must be used. Critical surfaces or those susceptible to high stress or wear must be lined with boron nitrides, silicon carbides or like materials.

This invention is applicable to aluminum-lithium alloys with a wide range of proportions. Most such alloys, however, contain lithium at levels ranging from about 1.0% to about 3.0% by weight.

The foregoing description is offered primarily for purposes of illustration. It will be readily apparent to those skilled in the art that numerous modifications and variations can be made beyond the particulars described herein without departing from the spirit and scope of the invention.

What is claimed is:

1. A method for preparing an aluminum-lithium alloy at a preselected ratio of aluminum to lithium, comprising:

(a) feeding molten aluminum to a first vessel through an entry conduit containing a tapered portion and flow-restricting pin of variable position extending into said tapered portion, said first vessel containing an orifice of preselected diameter, at a feed rate sufficient to maintain a head of molten aluminum above said orifice:

(b) detecting the level of molten aluminum in said first vessel, generating a first signal representative of said level, and varying the position of said flow-restricting pin relative to said tapered portion of said entry conduit to maintain said head at a preselected value, whereby molten aluminum is discharged from said first vessel at an aluminum discharge rate corresponding to said preselected diameter and said preselected value of said head;

(c) detecting said aluminum discharge rate and generating a second signal representative thereof:

(d) lowering a cylindrical plunger into a body of molten lithium in a second vessel at a volumetric displacement rate to displace said molten lithium toward an overflow port in said second vessel, whereby lithium is discharged from said second vessel through said overflow port at a lithium discharge rate substantially equal to said volumetric displacement rate, said volumetric displacement rate being controlled by said second signal in accordance with said preselected ratio: and (e) combining said aluminum discharged through said orifice with said lithium discharged through said overflow port to form a substantially uniform molten mixture at said preselected ratio, and solidifying said molten mixture.

2. A method for feeding molten lithium at a controlled rate to a mixing vessel in the manufacture of an aluminum-lithium alloy, comprising:

(a) charging a holding vessel with molten lithium to a level below an overflow port in said holding vessel;

(b) advancing a variable speed motor-driven plunger into the molten lithium in said holding vessel at a predetermined rate controlled by running the variable speed motor at a selected speed to displace said molten lithium toward said overflow port, whereby molten lithium is discharged from said holding vessel through said overflow port at substantially said predetermined volumetric rate; and (c) feeding said discharged molten lithium into said mixing vessel.

3. A method according to claim 2 in which said holding vessel is an enclosed chamber purged with inert gas, and said overflow port is positioned to maintain a gas space above said molten lithium contained in said enclosed chamber.

4. A method according to claim 3 in which said plunger is a vertical cylinder contained within said enclosed chamber, and step (b) comprises submerging said vertical cylinder in said molten lithium to increasing depths at said predetermined volumetric rate.

5. A method for preparing an aluminum-lithium alloy at a preselected ratio of aluminum to lithium comprising:

(a) feeding molten aluminum to a first vessel equipped with an orfice of preselected diameter, at a feed rate controlled to maintain a preselected head of molten aluminum above said orifice, said preselected head is established by detecing the level of molten aluminum in said first vessel, generating a signal representative of said level, and varying the feed rate of said molten aluminum to said first vessel in accordance with said signal;

(b) advancing a variable speed motor-driven plunger at a predetermined volumetric rate, said rate being controlled by running the variable speed motor at a selected speed, into a body of molten lithium toward in a second vessel to displace molten lithium an overflow port in said second vessel spaced above the bottom thereof, whereby molten lithium is discharged from said second vessel through said overflow port at a lithium discharge rate substantially equal to said predetermined volumetric rate;

(c) coordinating said aluminum discharge rate and said lithium discharge rate according to said preselected ratio; and (d) combining aluminum discharged through said orifice with lithium discharged through said overflow port continuously to form a substantially uniform molten mixture at said preselected ratio, and solidifying said molten mixture.

6. A method according to claim 5 in which step (a) includes detecting the height of a float floating on the surface of said molten aluminum, generating a signal representative of said height, and varying the position of a flow-restricting pin positioned to restrict the rate of feed of said molten aluminum to said first vessel according to said height, to maintain said preselected head.

7. A method according to claim 5, in which step (c) comprises generating a signal representative of said aluminum discharge rate of step (a) and controlling the rate of advance of said plunger of step (b) in accordance with said signal to achieve said preselected ratio.

8. A method according to claim 5, in which step (c) comprises generating a signal representative of said aluminum discharge rate of step (a) and directing said signal to a closed-looped electronic cascade control system driving a variable speed motor controlling the rate of advance of said plunger into said body of molten aluminum.

9. A method according to claim 5, in which the molten aluminum is sparged with an inert gas prior to step (a) to remove substantially all hydrogen present in the molten aluminum and to cause flotation of substantially all oxides present in the molten aluminum.

10. A method according to claim 5, in which the molten mixture of step (d) is sparged with argon to remove substantially all hydrogen present in the molten mixture and to cause flotation of substantially all oxides present.

* * * * *